US008401422B2

(12) United States Patent
Tanaka et al.

(10) Patent No.: US 8,401,422 B2
(45) Date of Patent: Mar. 19, 2013

(54) CLEANING APPARATUS AND IMAGE FORMING APPARATUS

(75) Inventors: Hideaki Tanaka, Fussa (JP); Kazuteru Ishizuka, Saitama (JP)

(73) Assignee: Konica Minolta Business Technologies, Inc. (JP)

( * ) Notice: Subject to any disclaimer, the term of this patent is extended or adjusted under 35 U.S.C. 154(b) by 230 days.

(21) Appl. No.: 12/860,233

(22) Filed: Aug. 20, 2010

(65) Prior Publication Data

US 2011/0044718 A1 Feb. 24, 2011

(30) Foreign Application Priority Data

Aug. 20, 2009 (JP) ..... 2009-190778

(51) Int. Cl.
*G03G 15/02* (2006.01)

(52) U.S. Cl. ..... 399/101; 399/123; 399/343; 399/350

(58) Field of Classification Search ..... 399/101, 399/123, 343, 350
See application file for complete search history.

(56) References Cited

U.S. PATENT DOCUMENTS

2003/0152407 A1* 8/2003 Hatano ..... 399/350

FOREIGN PATENT DOCUMENTS

| | | | |
|---|---|---|---|
| JP | 2001-42724 | A | 2/2001 |
| JP | 2004-78113 | A | 3/2004 |
| JP | 2004-109837 | A | 4/2004 |
| JP | 2005-249915 | A | 9/2005 |
| JP | 2009-8904 | A | 1/2009 |
| JP | 2009-109569 | A | 5/2009 |

OTHER PUBLICATIONS

Japanese Office Action for Japanese Patent Application No. 2009-190778 mailed Jun. 14, 2011, with English translation.

* cited by examiner

*Primary Examiner* — Walter L Lindsay, Jr.
*Assistant Examiner* — Roy Y Yi
(74) *Attorney, Agent, or Firm* — Cantor Colburn LLP

(57) ABSTRACT

Disclosed is a cleaning apparatus including: a blade and a roller to remove the residual toner on the image carrier, the blade and the roller provided on a downstream side of a rotating direction of the image carrier than a transfer position of the toner image; a scraper to remove toner attached to the roller; and a first controlling section to control movement of the residual toner removed by the blade and the roller, the first controlling section is provided on an upstream side of the rotating direction of the image carrier than the blade and on a downstream side of the rotating direction of the image carrier than the roller and the scraper, and the first controlling section is provided facing the image carrier with a certain area provided in between to form an accumulating section to accumulate residual toner in the certain area.

7 Claims, 12 Drawing Sheets

FIG.4

| | MATERIAL | HARDNESS | CONTACTING ANGLE | DIAMETER/ WIDTH, ETC. | ROTATING SPEED |
|---|---|---|---|---|---|
| BLADE | URETHANE | 77° | 20° | – | – |
| ROLLER | NBR FOAM RUBBER | ASKER C 33° | – | DIAMETER:17.5 mm | 1.3 TIMES OF TRANSFER BELT |
| SCRAPER | PET | – | 10° | THICKNESS:50 μm<br>LENGTH:9mm<br>WIDTH IN AXIS DIRECTION:330mm | – |
| FIRST CONTROLLING SECTION | PET | – | – | THICKNESS:360 μm<br>LENGTH:5mm<br>WIDTH IN AXIS DIRECTION:330mm | – |
| SECOND CONTROLLING SECTION | PET | – | – | THICKNESS:100 μm,<br>LENGTH:7.5mm<br>WIDTH IN AXIS DIRECTION:330mm | – |

FIG. 6

< RESULT 2 OF EVALUATION TEST >

| SUPPLIED AMOUNT OF TONER | ACCUMULATED AMOUNT OF TONER | | |
|---|---|---|---|
| | EXAMPLE 1 | COMPARATIVE EXAMPLE 1 | COMPARATIVE EXAMPLE 2 |
| VERY SMALL | POOR | POOR | POOR |
| SMALL | GOOD | POOR | POOR |
| MEDIUM | EXCELLENT | EXCELLENT | POOR |
| LARGE | EXCELLENT | GOOD | POOR |

FIG. 7

< RESULT 3 OF EVALUATION TEST >

| | SUPPLIED AMOUNT OF TONER | EDGE STATE OF BLADE | | BLADE TURN | FILMING |
|---|---|---|---|---|---|
| | | WEARING AMOUNT | WEARING STATE | | |
| EXAMPLE 2 | VERY SMALL | GOOD | GOOD | GOOD | GOOD |
| | SMALL | GOOD | GOOD | GOOD | GOOD |
| | MEDIUM | GOOD | GOOD | GOOD | GOOD |
| | LARGE | GOOD | GOOD | GOOD | GOOD |
| EXAMPLE 3 | VERY SMALL | POOR | POOR | GOOD | POOR |
| | SMALL | GOOD | ACCEPTABLE | GOOD | ACCEPTABLE |
| | MEDIUM | GOOD | GOOD | GOOD | GOOD |
| | LARGE | GOOD | GOOD | GOOD | GOOD |
| COMPARATIVE EXAMPLE 4 | SMALL | GOOD | GOOD | GOOD | GOOD |
| | MEDIUM | GOOD | GOOD | GOOD | GOOD |
| COMPARATIVE EXAMPLE 5 | SMALL | ※ | ※ | POOR | ※ |
| | MEDIUM | POOR | POOR | GOOD | POOR |

※ EVALUATION NOT POSSIBLE DUE TO BLADE TURN

CLEANING APPARATUS AND IMAGE FORMING APPARATUS

BACKGROUND

1. Field of the Invention

The present invention relates to a cleaning apparatus and an image forming apparatus.

2. Description of Related Art

In a color image forming apparatus, toner images of each color of YMCK are transferred onto a transfer belt (primary transfer) and the images are further transferred from the transfer belt to the paper (secondary transfer).

After the toner image is transferred onto the paper, residual toner which is not transferred in the secondary transfer remains on the transfer belt. In order to remove the residual toner, a cleaning apparatus is provided in a downstream side of the rotating direction of the transfer belt from the position of secondary transfer.

Generally, the cleaning apparatus is composed including a blade, a brush, a roller, etc. and these are used to remove the residual toner on the transfer belt. Especially, the blade is lately noted as an important component because the blade directly and physically peels off the residual toner on the transfer belt. As for the structure of the blade or surroundings of the blade, there are the following conventional techniques.

Japanese Patent Application Laid-Open Publication No. 2001-42724 discloses a cleaning apparatus where toner is always deposited (accumulated) in a certain area near a contacting section where a blade and transfer belt is in contact with each other and frictional force between the blade and the transfer belt is reduced due to the accumulated toner.

When the frictional force between the blade and the transfer belt is large, the wearing of the blade or the transfer belt is drastic, and these components need to be exchanged in a short period of time. Also, there is a possibility of the blade turning and filming (residual toner which is not wiped) and the image quality drastically decreases.

Japanese Patent Application Laid-Open Publication No. 2004-78113 discloses a cleaning apparatus where the blade accumulates a portion of the removed toner in an accumulating section and the accumulated toner is supplied to the transfer belt to prevent turn of the blade.

Japanese Patent Application Laid-Open Publication No. 2004-109837 discloses a cleaning apparatus where the movement of the toner removed by the blade is controlled by a controlling member and the toner is always in contact with the transfer belt to prevent turn of the blade.

Japanese Patent Application Laid-Open Publication No. 2005-249915 discloses a cleaning apparatus where the toner removed by the blade is accumulated in a space formed by a toner guide member or toner discharging control member and the toner is always supplied to the pressured section between the blade and the transfer belt to prevent turn of the blade.

According to the above conventional cleaning apparatus, all of these include a structure where residual toner is accumulated in the upstream side of the rotating direction of the transfer belt than the blade. The accumulated toner spreads on the rotating transfer belt and a lubricant agent can be supplied to the transfer belt through the toner. When the lubricant agent is supplied on the transfer belt, the wearing of the blade or the transfer belt is reduced. Also, the filming on the transfer belt and the turn of the blade do not occur easily.

However, there is a case where the accumulated toner does not spread on the transfer belt due to the provided position in the image forming apparatus or the amount of the residual toner.

Here, the configuration around the blade of the cleaning apparatus is described with reference to FIG. 8A and FIG. 9A. Also, graphs showing a relation between toner amount and contact width, and a relation between the toner amount and toner pressure is described with reference to FIG. 8B and FIG. 9B.

As shown in FIG. 8A and FIG. 9A, the surrounding of the blade is composed of a blade 11, a roller 12, a scraper 13, a transfer belt B1, etc.

Also, an accumulating section S1 to accumulate toner is formed in the upstream side of the rotating direction of the transfer belt B1 than the blade 11, between the blade 11 and the roller 12.

In FIG. 8A, the accumulating section S1 is formed in a position where the transfer belt B1 is in a vertical direction.

With reference to FIG. 8B, as the accumulated toner amount increases, the contact width where the toner and the transfer belt B1 is in contact increases. When the contact width is increased, sufficient amount of the lubricant agent can be supplied to the transfer belt B1. On the other hand, when the accumulated toner amount increases too much, the toner pressure on the blade 11 becomes large and trouble in the cleaning occurs. Due to the above, the appropriate range of the accumulated toner amount is the allowable width W1 shown in FIG. 8B.

In FIG. 9A, the accumulating section S1 is formed in a position where the transfer belt B1 is tilted 45° from the vertical direction. As shown in FIG. 9A, the advantage of providing the blade 11, the roller 12, etc. (the cleaning apparatus) in a position where the transfer belt B1 is tilted 45° is that the image forming apparatus can be made smaller.

With reference to FIG. 9B, until the accumulated toner amount is a certain amount or more, the contact width in contact with the transfer belt B1 is close to 0. In other words, until the accumulated toner amount is a certain amount or more, as shown in FIG. 9A, the accumulating section S1 does not spread to the transfer belt B1, and the lubricant agent is not supplied to the transfer belt B1. On the other hand, as the sliding increases, the accumulated toner amount is increased, and when the accumulated toner increases too much, the toner pressure on the blade 11 becomes large and the trouble in the cleaning occurs. Due to the above, the appropriate range of the accumulated toner amount is small and the appropriate range is the allowable width W2 shown in FIG. 9B.

The allowable width W1 shown in FIG. 8B compared to the allowable width W2 shown in FIG. 9B can be represented as "allowable width W1>allowable width W2". Therefore, due to a problem of the configuration of the machine (for example, in order to make the image forming apparatus smaller), when the cleaning apparatus of the conventional configuration is placed as is in a position as shown in FIG. 9A, there is a problem that the allowable width W2 becomes extremely small. When the allowable width W2 is small, the lubricant agent cannot be stably supplied to the transfer belt and problems such as wearing of the blade or the transfer belt, decrease of image quality due to blade turning or filming, etc. occur.

SUMMARY

The present invention has been made in consideration of the above problems, and it is one of main objects to provide a cleaning apparatus which can form an accumulating section to stably supply a lubricant agent to a transfer belt regardless of where the cleaning apparatus is positioned and an image forming apparatus.

In order to achieve at least one of the above-described objects, according to an aspect of the present invention, there is provided a cleaning apparatus to remove residual toner of a toner image transferred on a rotating image carrier, the cleaning apparatus including:

a blade and a roller to remove the residual toner on the image carrier, the blade and the roller provided on a downstream side of a rotating direction of the image carrier than a transfer position of the toner image;

a scraper to remove toner attached to the roller; and a first controlling section to control movement of the residual toner removed by the blade and the roller, wherein the first controlling section is provided on an upstream side of the rotating direction of the image carrier than the blade and on a downstream side of the rotating direction of the image carrier than the roller and the scraper, and the first controlling section is provided facing the image carrier with a certain area provided in between to form an accumulating section to accumulate residual toner in the certain area.

According to another aspect of the present invention, there is provided an image forming apparatus including a cleaning apparatus to remove residual toner of a toner image transferred on a rotating image carrier, the cleaning apparatus including:

a blade and a roller to remove the residual toner on the image carrier, the blade and the roller provided on a downstream side of a rotating direction of the image carrier than a transfer position of the toner image;

a scraper to remove toner attached to the roller; and a first controlling section to control movement of the residual toner removed by the blade and the roller, wherein the first controlling section is provided on an upstream side of the rotating direction of the image carrier than the blade and on a downstream side of the rotating direction of the image carrier than the roller and the scraper, and the first controlling section is provided facing the image carrier with a certain area provided in between to form an accumulating section to accumulate residual toner in the certain area.

BRIEF DESCRIPTION OF THE DRAWINGS

The present invention will become more fully understood from the detailed description given hereinbelow and the appended drawings, and thus are not intended to define the limits of the present invention, and wherein;

FIG. 4 is a table showing a condition of a cleaning apparatus;

FIG. 6 is a diagram showing a result of an evaluation test;

FIG. 7 is a diagram showing a result of an evaluation test;

DETAILED DESCRIPTION OF PREFERRED EMBODIMENTS

A configuration and operation of a cleaning apparatus and an image forming apparatus reflecting an aspect of the present embodiment is described in detail with reference to the drawings. However, the scope of the invention is not limited to the illustrated examples.

The present embodiment is described with a color image forming apparatus as an example. Alternatively, for example, a black and white image forming apparatus can be used to realize the present invention.

Figure 1:
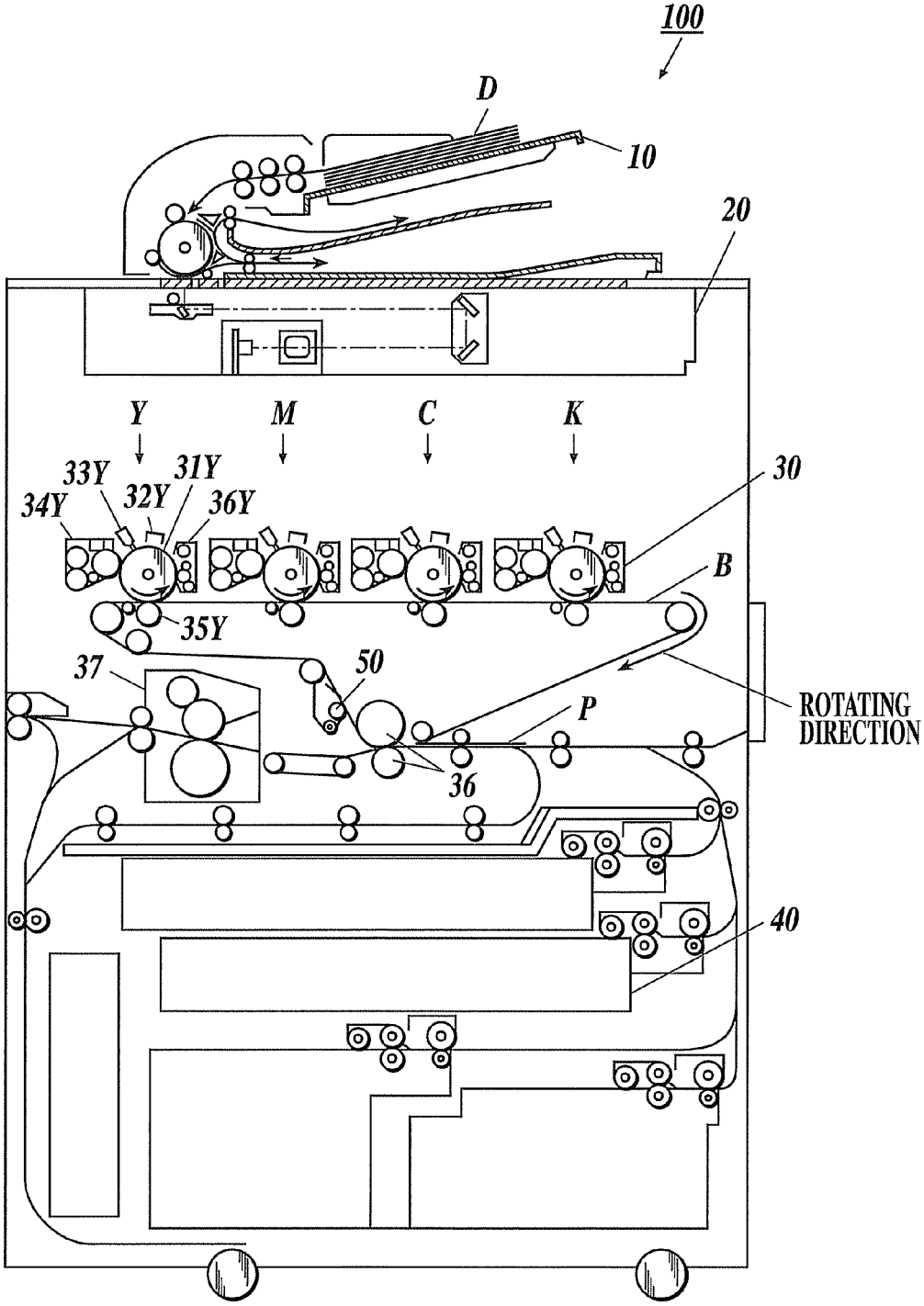
FIG. 1 is an overall view showing a configuration of an image forming apparatus.

FIG. 1 shows an overall configuration of the image forming apparatus 100.

The image forming apparatus 100 includes an automatic document feeding section 10, scanner section 20, image forming section 30, paper feeding section 40 and cleaning apparatus 50.

The automatic document feeding section 10 feeds a document D placed on the document placement tray one sheet at a time to a predetermined conveying path.

In the scanner section 20, a light source emits light to the conveyed document D and the light reflected on the document D is received. In the scanner section 20, the received light signal is converted to an electric signal (image data) and the converted image data is output to the image forming section 30.

The image forming section 30 includes a yellow imaging section Y, magenta imaging section M, cyan imaging section C, black imaging section K, etc. Each imaging section of YMCK are arranged along the transfer belt B.

The yellow imaging section Y includes a photoreceptor 31Y, charging device 32Y, light exposing device 33Y, developing device 34Y, transfer roller 35Y, cleaning apparatus 36Y, etc.

The yellow imaging section Y inputs image data output from the scanner section 20 and according to the input image data, forms an electrostatic latent image with the charging device 32Y and the light exposing device 33Y on the photoreceptor 31Y.

Based on the formed electrostatic latent image, the yellow imaging section Y forms a toner image on the photoreceptor 31Y with the developing device 34Y.

The yellow imaging section Y transfers the formed toner image on the transfer belt B with the transfer roller 35Y (primary transfer).

The yellow imaging section Y removes the residual toner remaining on the photoreceptor 31Y after the primary transfer with the cleaning apparatus 36Y. A later described cleaning apparatus 50 of the present embodiment can be applied as the cleaning apparatus 36Y referred to here.

The magenta imaging section M, the cyan imaging section C and the black imaging section K have a configuration and perform an operation similar to the yellow imaging section Y, and therefore the description is omitted here.

The transfer belt B transferred with the toner images of each color of YMCK transfers the toner image onto a paper P conveyed from the paper feeding section 40 with the transfer roller 36 (secondary transfer).

The fixing device 37 fixes the toner image on which secondary transfer is performed onto the paper P. The paper P fixed with the toner image is ejected out of the image forming apparatus 100.

The paper feeding section 40 includes a plurality of trays and each tray can store a different type of paper P.

The paper feeding section 40 feeds the paper P to the image forming section 30 through the predetermined conveying path.

The cleaning apparatus 50 removes the residual toner remaining on the transfer belt B after the secondary transfer.

Figure 2:
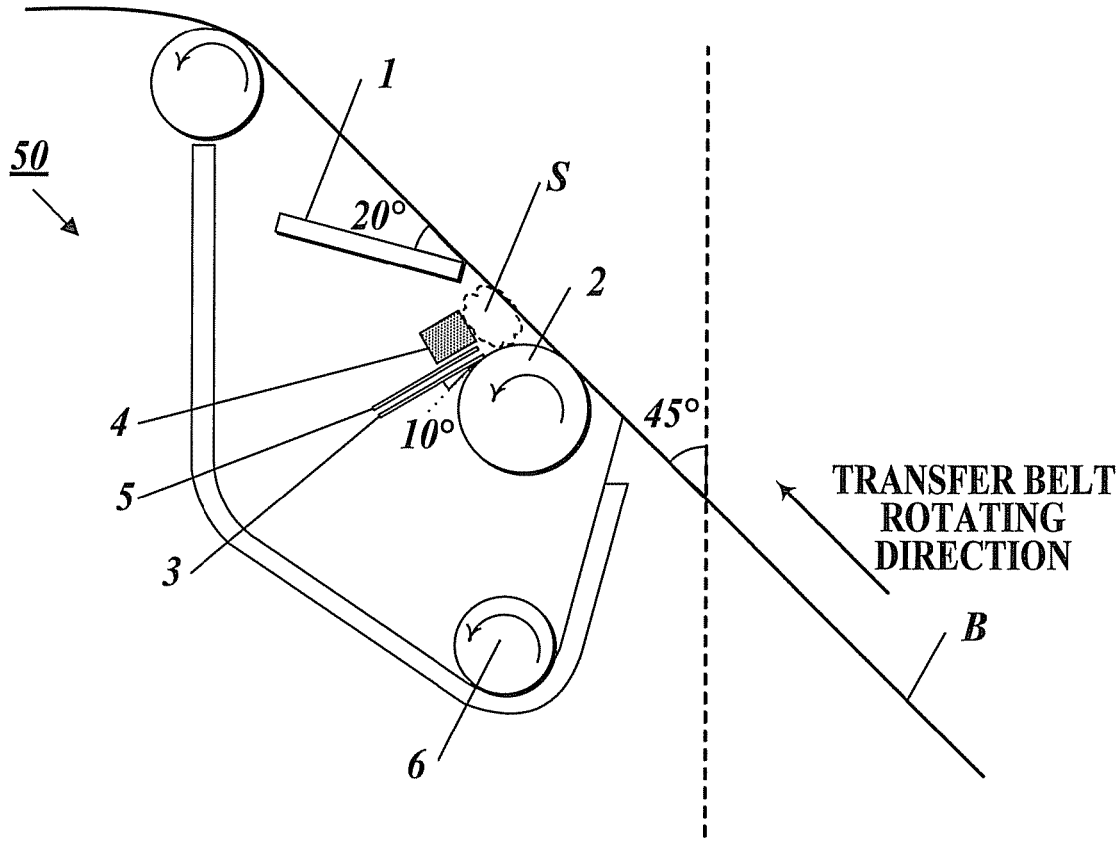
FIG. 2 is a cross sectional view showing a configuration of a cleaning apparatus.

FIG. 2 is a diagram showing a cross sectional view of configuration of the cleaning apparatus 50.

The cleaning apparatus 50 includes a blade 1, a roller 2, a scraper 3, a first controlling section 4, a second controlling section 5, a collecting screw 6, etc.

The cleaning apparatus 50 is provided in a position where the transfer belt B is tilted 45° from the vertical direction.

The blade 1 is formed from urethane rubber, etc. and one edge of the blade 1 is in contact with the transfer belt B so that the contacting angle is 20° and the other edge is fixed with adhesive to a blade holder which is not shown. The blade 1 peels off residual toner remaining on the transfer belt B with the edge that is in contact with the transfer belt B. The peeled off toner is accumulated in the accumulating section S or is collected by the collecting screw 6.

The roller 2 is formed from nitrile rubber (NBR) and rotates at a rotating speed about 1.3 times faster than the transfer belt B in the same direction in contact with the transfer belt B. The roller 2 is placed in the upstream side of the rotating direction of the transfer belt B than the blade 1.

The scraper 3 is made from polyethylene terephthalate (PET) and one edge of the scraper 3 is in contact with the surface of the roller 2 so that the contacting angle is 10° and the other edge is fixed by a holding member which is not shown. The scraper 3 controls the movement of the toner so that the toner is accumulated in the accumulating section S and also controls the toner so that when the toner amount accumulated in the accumulating section S is a certain amount or more, the toner is moved to the collecting screw 6. Such control is enabled by the position where the scraper 3 is provided or the material (PET) of the scraper 3.

The first controlling section 4 is formed from PET, etc. and is fixed and positioned by a holding member which is not shown with a predetermined space between the transfer belt B. The first controlling section 4 is provided on the upstream side than the blade 1 and the downstream side than the roller 2 with respect to the rotating direction of the transfer belt B. The first controlling section 4 controls the movement of the toner so that the toner is accumulated in the accumulating section S and also controls the toner so that when the toner amount accumulated in the accumulating section S is a certain amount or more, the toner is moved to the collecting screw 6.

In order to control the movement of the toner in the above fashion, the first controlling section 4 includes the features of changing the toner accumulated in the accumulating section S as necessary instead of accumulating the toner, and preventing blocking by the toner.

The second controlling section 5 is formed from PET, etc. and is fixed and positioned by a holding member which is not shown with a predetermined space between the transfer belt B. The second controlling section 5 is positioned between the scraper 3 and the first controlling section 4. Together with the first controlling section 4, the second controlling section 5 controls the movement of the toner so that the toner is accumulated in the accumulating section S and also controls the toner so that when the toner amount accumulated in the accumulating section S is a certain amount or more, the toner is moved to the collecting screw 6.

The collecting screw 6 is positioned on the base of the cleaning apparatus 50 and ejects the toner which is moved to the base and accumulated outside the cleaning apparatus 50.

The accumulating section S is a pool of toner formed by the blade 1, roller 2, scraper 3, first controlling section 4 and second controlling section 5.

The accumulating section S always accumulates a certain amount of toner.

The operation of the accumulating section S is described with reference to FIG. 3A and FIG. 3B.

Figure 3A:
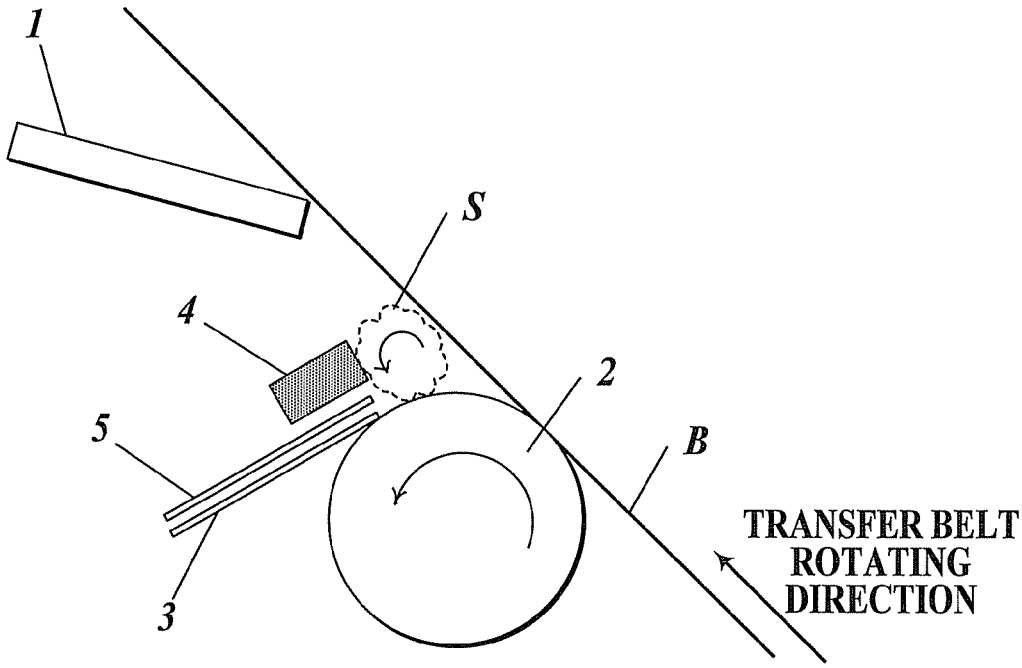
FIG. 3A is a conceptual view showing a movement of the accumulating section.

With reference to FIG. 3A, even when the amount of residual toner is small (for example, printing where print coverage rate is small) the movement of the toner is controlled by the first controlling section 4 and the second controlling section 5 so that the accumulating section S spreads to the transfer belt B. Therefore, the lubricant agent can be provided stably to the transfer belt B.

Figure 3B:
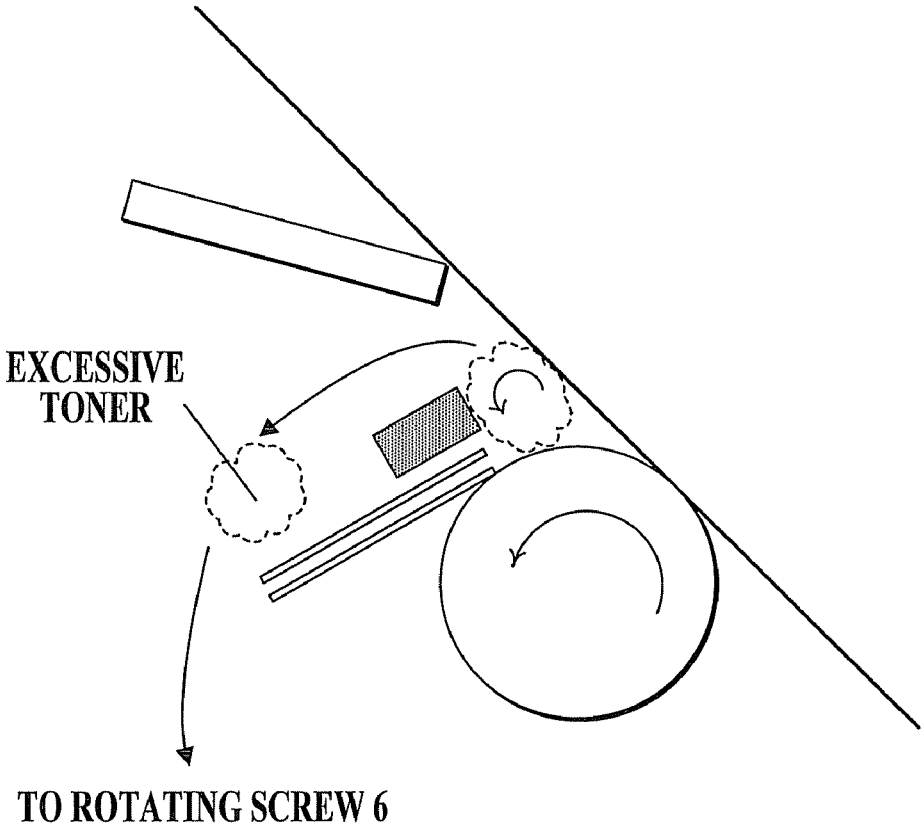
FIG. 3B is a conceptual view showing a movement of the accumulating section.

With reference to FIG. 3B, when the amount of residual toner is large (for example, printing where print coverage rate is large) the movement of the toner is controlled by the first controlling section 4 or the second controlling section 5 so that a certain amount of toner spreads to the transfer belt and the excess amount is moved to the collecting screw 6. Therefore, the toner pressure does not become too large for the blade 11.

Example 1

An evaluation test of performance of the accumulation of toner (whether or not just enough toner accumulates) in the accumulating section S is performed.

The evaluation test prints an actual document on 500 sheets of paper with an A4 size and then changes the print coverage rate and prints 500 sheets again. This is repeated a plurality of times. Changing the print coverage rate means to change the toner amount supplied to the cleaning apparatus 50. The toner amount in the accumulating section S is measured with respect to each 500 sheets of printing, in other words with respect to each supplied amount of toner.

According to this evaluation test, the relation between the supplied amount of toner and the accumulated amount of toner can be understood.

The condition of where the cleaning apparatus 50 is provided is a position where the transfer belt B is tilted 45° from the vertical direction as shown in FIG. 1 and FIG. 2. The inner configuration of the cleaning apparatus 50 is as shown in FIG. 2.

Other conditions are as shown in FIG. 4.

Comparative Example 1

As a comparative example of the above example 1, the cleaning apparatus with a conventional configuration (hereinafter referred to as "cleaning apparatus of the comparative example 1") is used to perform the evaluation test similar to the test performed on the example 1. The position where the cleaning apparatus of the comparative example 1 is provided is a position where the transfer belt is tilted 45° from the vertical direction similar to the position in example 1.

The internal configuration of the cleaning apparatus of the comparative example 1 is similar to the cleaning apparatus (see FIG. 2) described in the Japanese Patent Application Laid-Open Publication No. 2005-249915 referred in the "Description of Related Art". The difference between the cleaning apparatus of the comparative example 1 and the cleaning apparatus 50 of the present embodiment is that the cleaning apparatus of the comparative example 1 does not include the first controlling section 4 and the second controlling section 5 and the position where the scraper 3 is provided is different.

Comparative Example 2

As a comparative example of the above described example 1, further, a cleaning apparatus where the first controlling section 4 and the second controlling section 5 is removed from the components of the cleaning apparatus 50 (hereinafter referred to as "cleaning apparatus of the comparative example 2") is used to perform the evaluation test similar to the test performed on the example 1. The position where the cleaning apparatus of the comparative example 2 is provided is a position where the transfer belt is tilted 45° from the vertical direction similar to the position in example 1.

The difference between the cleaning apparatus of the comparative example 2 and the cleaning apparatus 50 of the present embodiment is, as described above, that the cleaning apparatus of the comparative example 2 does not include the first controlling section 4 and the second controlling section 5.

Also, the difference between the cleaning apparatus of the comparative example 2 and the cleaning apparatus of the comparative example 1 is that the cleaning apparatus of the comparative example 2 does not have a scraper.

[Result 1]

Figure 5:
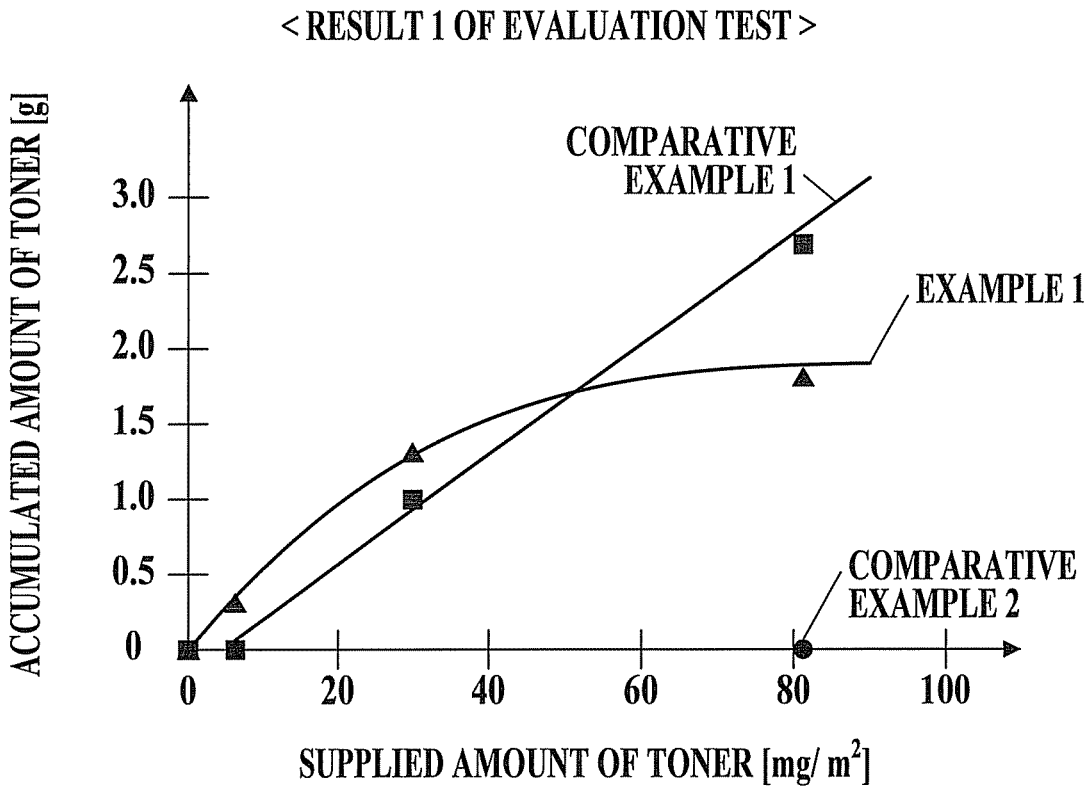
FIG. 5 is a diagram showing a result of an evaluation test.
Figure 8A:
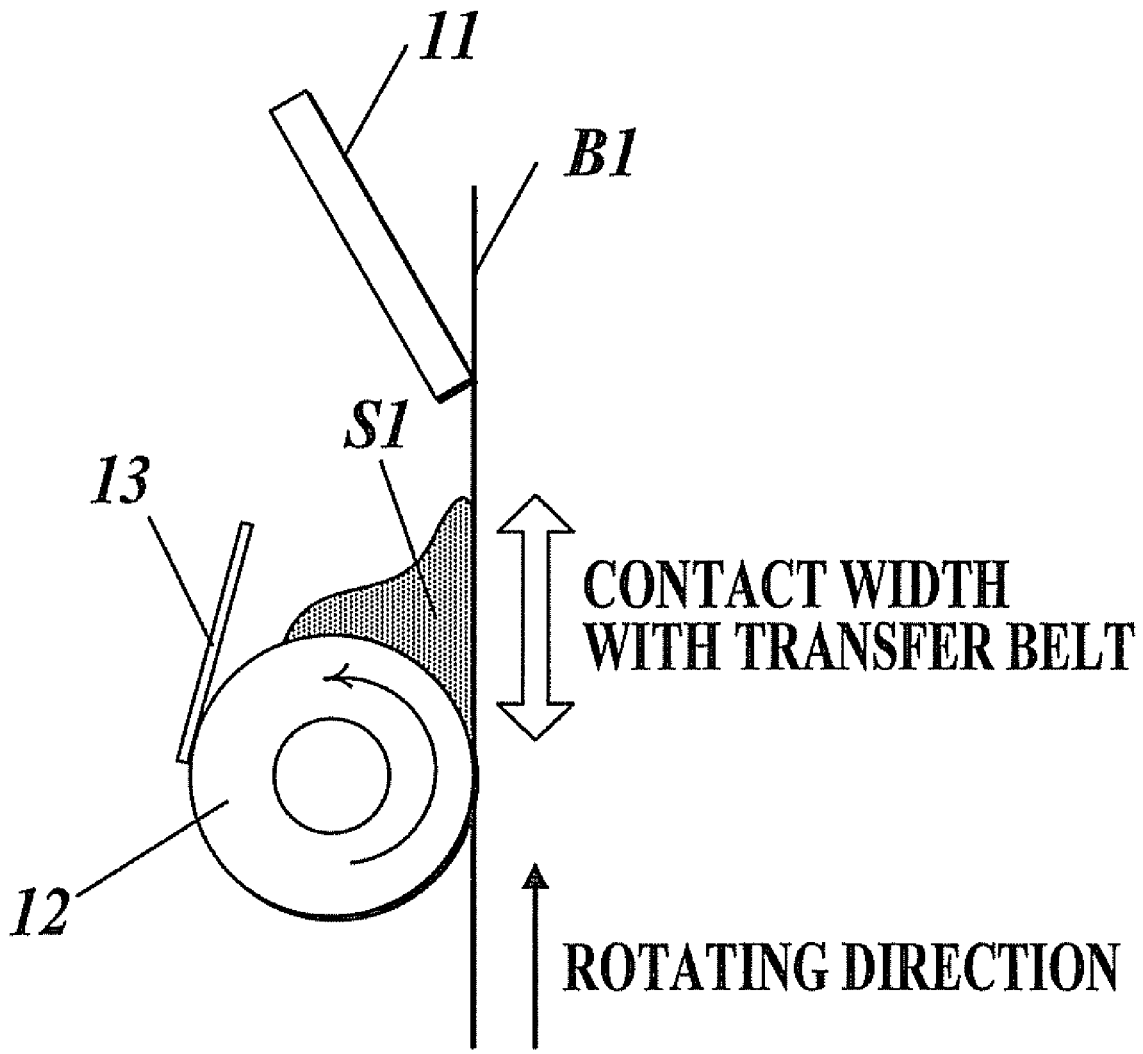
FIG. 8A is a diagram showing a configuration around a blade in a cleaning apparatus.
Figure 8B:
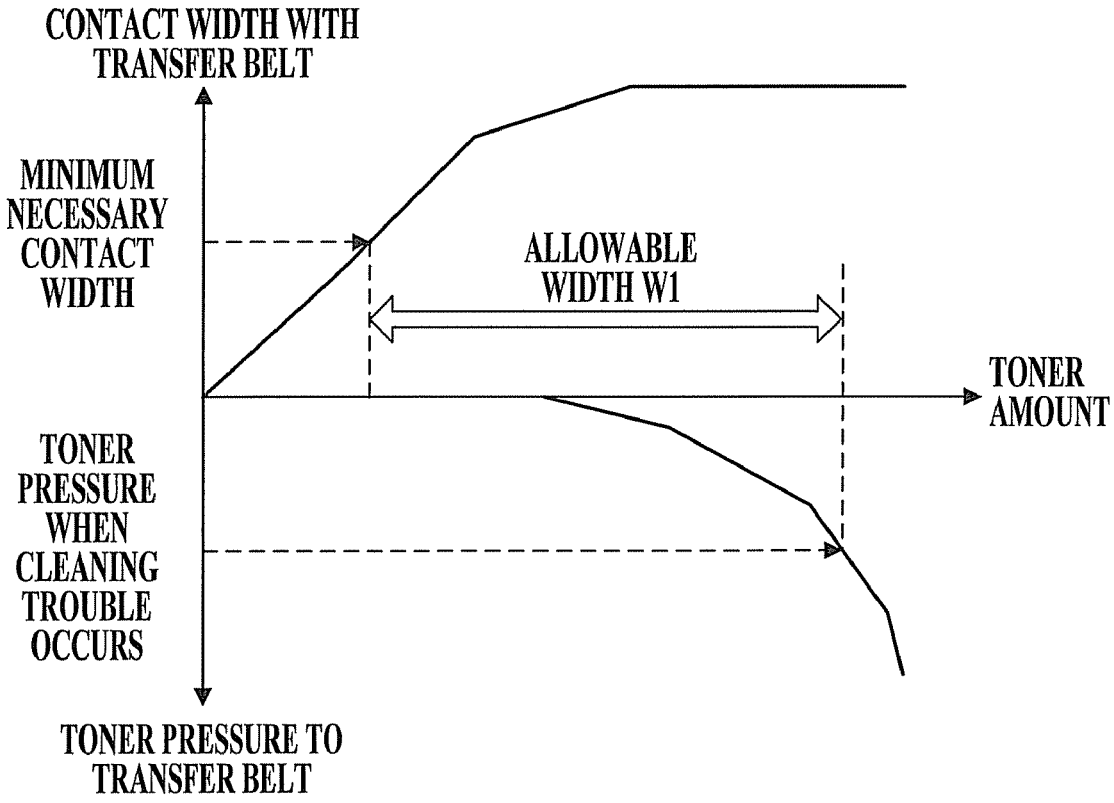
FIG. 8B is a graph showing a relation between a toner amount and contact width and toner amount and toner pressure.
Figure 9A:
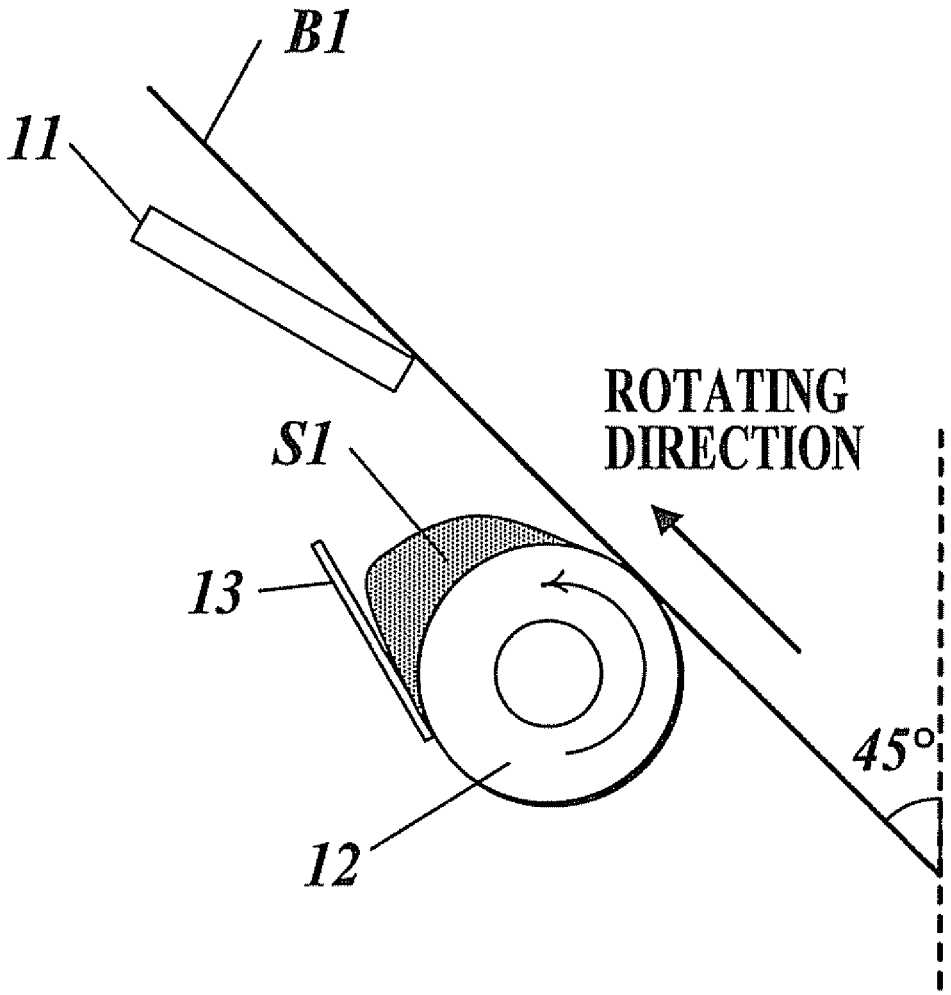
FIG. 9A is a diagram showing a configuration around a blade in a cleaning apparatus.
Figure 9B:
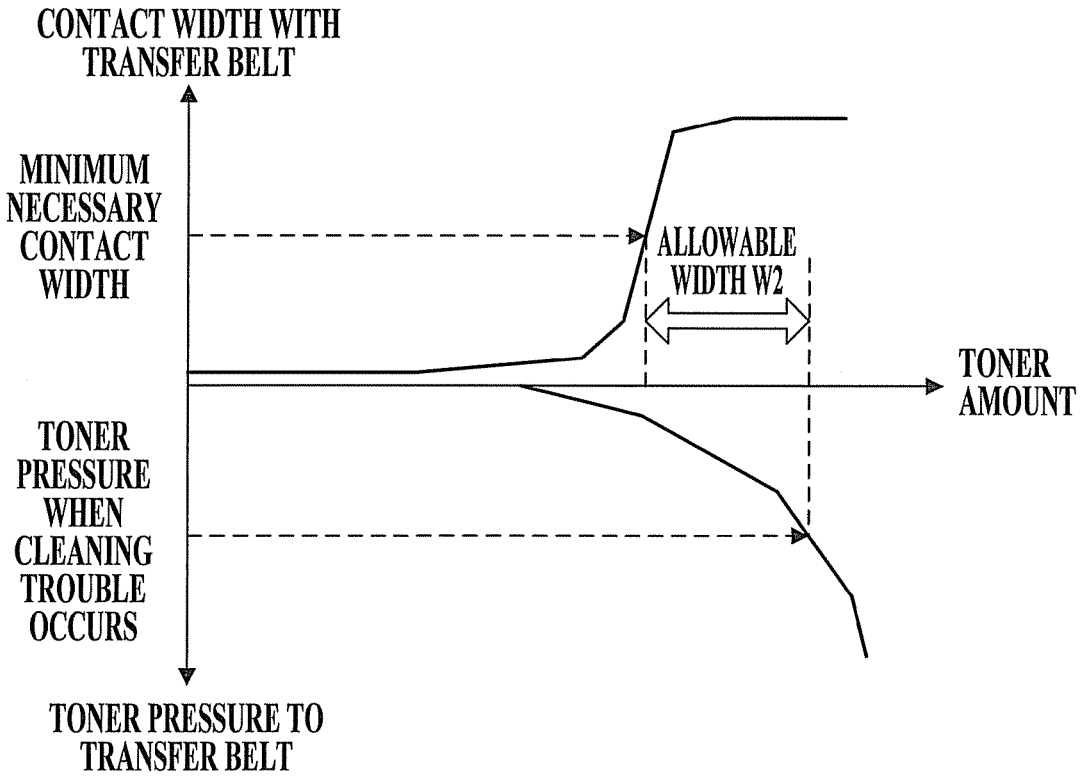
FIG. 9B is a graph showing a relation between a toner amount and contact width and toner amount and toner pressure.

FIG. 5 shows a result 1 of the evaluation test performed on the example 1, comparative example 1 and the comparative example 2. As shown in FIG. 5, as for the example 1 and the comparative example 1, as the supplied amount of toner increases, the accumulated amount of toner increases. This is because the accumulating section S is formed by the first controlling section 4, the second controlling section 5 or the scraper 3.

A characteristic of the example 1 is that the toner easily accumulates even when the amount of supplied toner is small and a certain amount of toner is accumulated in the accumulating section S. For example, when the amount of supplied toner is 20 mg/m$^2$, the accumulated amount of toner is about 1 g.

Another characteristic of the example 1 is that as the amount of supplied toner becomes large, an increasing rate of the accumulated amount of toner becomes low and only a certain amount of toner accumulates as the accumulated amount of the toner in the accumulating section S. For example, the accumulated amount of toner is about 1.8 g for both 70 mg/m$^2$ and 80 mg/m$^2$ of supplied toner.

In the comparative example 1, when the amount of supplied toner is small, only a small amount of toner accumulates in the accumulating section. For example, when the amount of supplied toner is 20 mg/m$^2$, the accumulated amount of toner is about 0.5 g and the amount is smaller than the example 1.

Also, even when the amount of supplied toner becomes large, the increasing rate of the accumulated amount of toner is fixed and the accumulated amount of toner in the accumulating section S may exceed the proper amount. For example, when the amount of supplied toner is 70 mg/m$^2$, the accumulated amount of toner is about 2.4 g, and when the amount of supplied toner is 80 mg/m$^2$, the accumulated amount of toner is about 2.7 g.

In the comparative example 2, even when the supplied amount of toner becomes large, the accumulated amount of toner does not change at 0 g, and the toner does not accumulate. This is because, since there is no controlling section, scraper, etc., the accumulating section is not formed.

[Result 2]

FIG. 6 shows a result 2 of the evaluation test performed on the example 1, comparative example 1 and comparative example 2.

The result 2 of the evaluation test shown in FIG. 6 is a table showing the relation between the supplied amount of toner and the accumulated amount of toner.

When the supplied amount of toner is very small, small, medium or large (for example, very small=1 mg/m$^2$ or smaller, small=3 mg/m$^2$, medium=30 mg/m$^2$, large=80 mg/m$^2$), evaluation of the accumulated amount of toner in the accumulating section S within a range of 0.2 g to 3.0 g is good, a further narrow range of 0.5 g to 2.5 g is excellent, and a range other than the above is poor.

When the accumulated amount of toner in the accumulating section S is less than 0.2 g, the wearing amount of the blade 1 increases, and there is a possibility the toner slips through (cleaning trouble) or filming in the transfer belt B occurs.

Also, when the accumulated amount of toner in the accumulating section S is 3 g or more, the amount of toner in the accumulating section S becomes a saturated state, and there is a possibility that toner blocking occurs which causes toner to slip through (cleaning trouble) due to the toner pressure on the blade 11.

In the example 1, when the supplied amount of toner is very small, the accumulated amount of toner in the accumulating section S is 0.2 g or less and evaluation is poor. However, when the supplied amount of toner is small, medium or large, the accumulated amount of toner in the accumulating section S is within a range of 0.2 g to 3.0 g or 0.5 g to 2.5 g and the evaluation is good or excellent.

In the comparative example 1, when the supplied amount of toner is very small or small, the accumulated amount of toner in the accumulating section is 0.2 g or less and the evaluation is poor. However, when the supplied amount of toner is medium or large, the accumulated amount of toner in the accumulating section is within a range of 0.2 g to 3.0 g or 0.5 g to 2.5 g and the evaluation is good or excellent.

In the comparative example 2, regardless of the supplied amount of toner, the accumulated amount of toner in the accumulating section is 0.2 g or less and the evaluation is always poor.

As described above, according to the result 1 and the result 2 of the evaluation test, in the example 1, a certain amount of toner can be formed as the accumulating section S when the supplied amount of toner is small. When the supplied amount of toner is too large, a certain amount of toner can be used to form the accumulating section S while moving the excess amount to the collecting screw 6.

Example 2

Next, an evaluation test of the effect of preventing wearing of the blade 1 and the filming of the transfer belt B is performed.

The evaluation test is performed in a normal environment (25° C. and 50% humidity) and actual documents are printed on 50,000 sheets of paper with an A4 size and then the print coverage rate is changed and another 50,000 sheets are printed. This is repeated a plurality of times. Changing the print coverage rate means to change the amount of toner supplied to the cleaning apparatus 50. A predetermined evaluation of the state of the edge of the blade 1 is performed and whether or not there is a turn of the blade and whether or not there is filming on the transfer belt B is evaluated visually with respect to each printing of 50,000 sheets, in other words, with respect to each supplied amount of toner.

The item "predetermined evaluation" of the state of the edge of the blade 1 includes "wearing amount" of the edge of the blade 1 on the side in contact with the transfer belt B (whether the wearing amount is larger or smaller than a predetermined average wearing amount) and "wearing state" of the edge (whether the wearing is even on the right and left, whether or not there is unevenness in the wearing, whether or not there is a chipped portion, etc.). The evaluation is, the wearing amount larger than the average value is poor and smaller than the average value is good. As for the wearing state, no uneven wearing, etc. is good, uneven wearing, etc. is poor or acceptable, and poor and acceptable are distinguished according to the degree of the wearing state.

As for the visual evaluation of whether or not there is blade turn, no blade turn is evaluated as good and presence of blade turn is evaluated as poor.

As for the visual evaluation of whether or not there is filming, no filming is evaluated as good and presence of filming is evaluated as poor or acceptable, and poor and acceptable are distinguished by the degree of filming.

The condition of where the cleaning apparatus 50 is provided is a position where the transfer belt B is tilted 45° from the vertical direction as shown in FIG. 1 and FIG. 2. The inner configuration of the cleaning apparatus 50 is as shown in FIG. 2.

Other conditions are as shown in FIG. 4.

Comparative Example 3

As a comparative example of the above example 2, the cleaning apparatus with a conventional configuration (hereinafter referred to as "cleaning apparatus of the comparative example 3") is used to perform the evaluation test similar to the test performed on the example 2. The position where the cleaning apparatus of the comparative example 3 is provided is a position where the transfer belt is tilted 45° from the vertical direction similar to the position in example 2.

The internal configuration of the cleaning apparatus of the comparative example 3 is similar to the cleaning apparatus (see FIG. 2) described in the Japanese Patent Application Laid-Open Publication No. 2005-249915 referred in the "Description of Related Art". This is similar to the above described comparative example 1. As described in the description of the comparative example 1, the difference between the cleaning apparatus of the comparative example 3 and the cleaning apparatus 50 of the present embodiment is that the cleaning apparatus of the comparative example 3 does not include the first controlling section 4 and the second controlling section 5 and the position where the scraper 3 is provided is different.

Comparative Example 4

As a comparative example of the above example 2, a cleaning apparatus of the conventional configuration (hereinafter referred to as "cleaning apparatus of the comparative example 4") is used to perform the evaluation test similar to the test performed on the example 2. The position where the cleaning apparatus of the comparative example 4 is provided is the same as the conventional technique which is where the transfer belt is in a vertical direction and the inner configuration of the cleaning apparatus of the comparative example 4 is similar to that of the comparative example 3.

Comparative Example 5

As a comparative example of the above described example 2, further, a cleaning apparatus where the first controlling section 4 and the second controlling section 5 is removed from the components of the cleaning apparatus 50 (hereinafter referred to as "cleaning apparatus of the comparative example 5") is used to perform the evaluation test similar to the test performed on the example 2. The position where the cleaning apparatus of the comparative example 5 is provided is a position where the transfer belt is tilted 45° from the vertical direction similar to the position in example 2.

The difference between the cleaning apparatus of the comparative example 5 and the cleaning apparatus 50 of the present embodiment is, as described above, that the cleaning apparatus of the comparative example 5 does not include the first controlling section 4 and the second controlling section 5.

Also, the difference between the cleaning apparatus of the comparative example 5 and the cleaning apparatus of the comparative example 3 is that the cleaning apparatus of the comparative example 5 does not have a scraper.

Also, the difference between the cleaning apparatus of the comparative example 5 and the cleaning apparatus of the comparative example 4 is that the cleaning apparatus of the comparative example 5 does not have a scraper and is provided in a position where the transfer belt is tilted 45° from the vertical direction.

[Result 3]

FIG. 7 shows a result 3 of the evaluation test performed on the example 2, comparative example 3, comparative example 4 and comparative example 5.

The result 3 of the evaluation test shown in FIG. 7 is a table showing supplied amount of toner, relation with the edge state of the blade (wearing amount and wearing state), whether or not there is blade turn and whether or not there is filming.

In the example 2, regardless of whether the supplied amount of toner is very small, small, medium or large (for example, hereinafter very small=1 mg/m$^2$ or smaller, small=3 mg/m$^2$, medium=30 mg/m$^2$, large=80 mg/m$^2$), the edge state of the blade 1 is good and the evaluation is good.

Also, blade turn does not occur and evaluation of blade turn is good. Also, filming on the transfer belt B does not occur and evaluation of filming is good.

In the comparative example 3, when the supplied amount of toner is very small, the wearing amount of the edge of the blade is large and uneven wearing is seen, therefore evaluation of the edge state of the blade (wearing amount and wearing state) is poor. When the supplied amount of toner is small, the wearing amount is an average value but some uneven wearing is seen, therefore evaluation of the wearing state is acceptable. When the supplied amount of toner is medium or large, the edge state of the blade is good and the evaluation is good.

Also, regardless of whether the supplied amount of toner is very small, small, medium or large, blade turn does not occur and therefore evaluation of blade turn is good.

Further, when the supplied amount of toner is very small or small, filming occurs on the transfer belt and the evaluation of filming is poor or acceptable. When the supplied amount of toner is medium or large, filming on the transfer belt does not occur and the evaluation of filming is good.

In the comparative example 4, regardless of whether the supplied amount of toner is small or medium, the edge state of the blade is good and the evaluation is good.

Also, regardless of whether the supplied amount of toner is small or medium, the blade turn does not occur and the evaluation of blade turn is good.

Further, regardless of whether the supplied amount of toner is small or medium, the filming on the transfer belt does not occur and the evaluation of filming is good.

In the comparative example 5, when the supplied amount of toner is small, blade turn occurs and the evaluation of edge state of the blade is not possible. When the supplied amount of toner is medium, the wearing amount is larger than the average value and uneven wearing occurs, and the evaluation of the edge state of the blade (wearing amount and wearing state) is poor.

Also, when the supplying amount of toner is small, blade turn occurs and the evaluation of blade turn is poor. When the supplying amount of toner is medium, blade turn does not occur and the evaluation of blade turn is good.

Further, when the supplying amount of toner is small, blade turn occurs and evaluation of filming is not possible. When the supplying amount of toner is medium, filming on the transfer belt occurs and the evaluation of filming is poor.

As described above, the result 3 of the evaluation test shows that according to the cleaning apparatus 50 of the example 2, even when the transfer belt B is tilted 45° from the vertical direction, the edge of the blade 1 wears at a proper amount and state, and blade turn and filming can be prevented.

According to an aspect of the preferred embodiments of the present invention, there is provided a cleaning apparatus to remove residual toner of a toner image transferred on a rotating image carrier, the cleaning apparatus including:

a blade and a roller to remove the residual toner on the image carrier, the blade and the roller provided on a downstream side of a rotating direction of the image carrier than a transfer position of the toner image;

a scraper to remove toner attached to the roller; and a first controlling section to control movement of the residual toner removed by the blade and the roller, wherein the first controlling section is provided on an upstream side of the rotating direction of the image carrier than the blade and on a downstream side of the rotating direction of the image carrier than the roller and the scraper, and the first controlling section is provided facing the image carrier with a certain area provided in between to form an accumulating section to accumulate residual toner in the certain area.

According to the above aspect of the cleaning apparatus, regardless of whether the supplied toner amount is small or large, the first controlling section 4 can form the accumulating section S with the proper amount of toner. Consequently, even in a position where it is conventionally difficult to form the accumulating section S with a certain amount of toner when the amount of supplied toner is small, the cleaning apparatus 50 can be provided. The degree of freedom of the position where the cleaning apparatus 50 can be provided is high, and therefore, a smaller image forming apparatus 100 can be realized while maintaining the conventional performance (preventing wearing of blade 1 or transfer belt B, preventing blade turn and filming, etc.)

Preferably, the cleaning apparatus further includes a second controlling section provided on an upstream side of the rotating direction of the image carrier than the first controlling section and on the downstream side of the rotating direction of the image carrier than the roller and the scraper, wherein the second controlling section controls the movement of the residual toner removed by the blade and the roller and forms the accumulating section with the first controlling section.

Consequently, together with the first controlling section, the second controlling section can control the movement of the residual toner removed by the blade and the roller to form the accumulating section.

Compared to when only the first controlling section 4 is provided, by also providing the second controlling section 5, the accumulating section S can be formed with a more proper amount of toner. Therefore, the degree of freedom of the position where the cleaning apparatus 50 can be provided can be further enhanced.

Preferably, in the cleaning apparatus, the first controlling section is mainly made from material of polyethylene terephthalate and is in a plate shape.

Consequently, by using PET as the main material, the toner can be controlled so that when the amount of supplied toner is small, the toner can be easily accumulated in the accumulating section S, and when the amount of supplied toner is large, the toner can be moved to the collecting screw 6 without accumulating the toner in the accumulating section S.

Preferably, in the cleaning apparatus, the second controlling section is mainly made from material of polyethylene terephthalate and is in a plate shape.

Consequently, by using PET as the main material, the toner can be controlled so that when the amount of supplied toner is small, the toner can be easily accumulated in the accumulating section S, and when the amount of supplied toner is large, the toner can be moved to the collecting screw 6 without accumulating the toner in the accumulating section S.

According to another aspect of the preferred embodiments of the present invention, there is provided an image forming apparatus including a cleaning apparatus to remove residual toner of a toner image transferred on a rotating image carrier, the cleaning apparatus includes:

a blade and a roller to remove the residual toner on the image carrier, the blade and the roller provided on a downstream side of a rotating direction of the image carrier than a transfer position of the toner image;

a scraper to remove toner attached to the roller; and a first controlling section to control movement of the residual toner removed by the blade and the roller, wherein the first controlling section is provided on an upstream side of the rotating direction of the image carrier than the blade and on a downstream side of the rotating direction of the image carrier than the roller and the scraper, and the first controlling section is provided facing the image carrier with a certain area provided in between to form an accumulating section to accumulate residual toner in the certain area.

Consequently, when the cleaning apparatus 50 provided with the first controlling section 4 is included in the cleaning mechanism of the image forming apparatus 100, conventional cleaning performance can be maintained while making the image forming apparatus 100 smaller.

Preferably, the image forming apparatus further includes a second controlling section provided on an upstream side of the rotating direction of the image carrier than the first controlling section and on the downstream side of the rotating direction of the image carrier than the roller and the scraper, wherein the second controlling section controls the movement of the residual toner removed by the blade and the roller and forms the accumulating section with the first controlling section.

Consequently, when the cleaning apparatus 50 provided with the first controlling section 4 and the second controlling section 5 is included in the cleaning mechanism of the image forming apparatus 100, compared to the cleaning apparatus provided with only the first controlling section 4, the accumulating section S can be formed with a more proper amount of toner.

Preferably, in the image forming apparatus, the image carrier is a transfer belt of a color image forming apparatus; and the cleaning apparatus is provided in a position where the transfer belt is tilted in a predetermined angle from a vertical direction.

Consequently, the cleaning apparatus 50 can be provided in a position where the transfer belt B of the image forming apparatus 100 is tilted 45° from the vertical direction. Even when the cleaning apparatus 50 is provided in this position, the cleaning apparatus 50 can achieve the desirable effects such as preventing wearing of the blade 1 or transfer belt B, preventing blade turn and filming, etc.

Although various exemplary embodiments have been shown and described, the invention is not limited to the embodiments shown. Therefore, the scope of the invention is intended to be limited solely by the scope of the claims that follow and not by the above explanation, and it is intended that the present invention covers modifications and variations that come within the scope of the appended claims and their equivalents.

The present U.S. Patent Application claims priority under the Paris Convention of Japanese Patent Application No. 2009-190778 filed on Aug. 20, 2009 to the Japanese Patent Office, which shall be a basis for correcting mistranslations.

What is claimed is:

1. A cleaning apparatus to remove residual toner of a toner image transferred on a rotating image carrier, the cleaning apparatus comprising:

a blade and a roller to remove the residual toner on the image carrier, the blade and the roller provided on a downstream side of a rotating direction of the image carrier than a transfer position of the toner image;

a scraper to remove toner attached to the roller; and a first controlling section to control movement of the residual toner removed by the blade and the roller, wherein the first controlling section is provided on an upstream side of the rotating direction of the image carrier than the blade and on a downstream side of the rotating direction of the image carrier than the roller and the scraper, and the first controlling section is provided facing the image carrier with a certain area provided in between to form an accumulating section to accumulate residual toner in the certain area surrounded by the image carrier, the blade, the roller, the scraper and the first controlling section; and the first controlling section controls movement of the toner so as to accumulate toner in the accumulating section.

2. The cleaning apparatus of claim 1, further comprising a second controlling section provided between the scraper and the first controlling section, on an upstream side of the rotating direction of the image carrier than the first controlling section and on the downstream side of the rotating direction of the image carrier than the roller and the scraper, wherein the second controlling section controls the movement of the residual toner removed by the blade and the roller so as to accumulate the toner in the accumulating section and forms the accumulating section with the first controlling section.

3. The cleaning apparatus of claim 1, wherein the first controlling section is mainly made from material of polyethylene terephthalate and is in a plate shape.

4. The cleaning apparatus of claim 2, wherein the second controlling section is mainly made from material of polyethylene terephthalate and is in a plate shape.

5. An image forming apparatus including a cleaning apparatus to remove residual toner of a toner image transferred on a rotating image carrier, the cleaning apparatus comprising:

a blade and a roller to remove the residual toner on the image carrier, the blade and the roller provided on a downstream side of a rotating direction of the image carrier than a transfer position of the toner image;

a scraper to remove toner attached to the roller; and a first controlling section to control movement of the residual toner removed by the blade and the roller, wherein the first controlling section is provided on an upstream side of the rotating direction of the image carrier than the blade and on a downstream side of the rotating direction of the image carrier than the roller and the scraper, and the first controlling section is provided facing the image carrier with a certain area provided in between to form an accumulating section to accumulate residual toner in the certain area surrounded by the image carrier, the blade, the roller, the scraper and the first controlling section; and the first controlling section controls movement of the toner so as to accumulate toner in the accumulating section.

6. The image forming apparatus of claim 5, further comprising a second controlling section provided between the scraper and the first controlling section, on an upstream side of the rotating direction of the image carrier than the first controlling section and on the downstream side of the rotating direction of the image carrier than the roller and the scraper, wherein the second controlling section controls the movement of the residual toner removed by the blade and the roller, so as to accumulate the toner in the accumulating section and forms the accumulating section with the first controlling section.

7. The image forming apparatus of claim 5, wherein the image carrier is a transfer belt of a color image forming apparatus; and the cleaning apparatus is provided in a position where the transfer belt is tilted in a predetermined angle from a vertical direction.

* * * * *